United States Patent [19]

Howard, Sr.

[11] Patent Number: 4,558,738

[45] Date of Patent: Dec. 17, 1985

[54] OIL WELL CASING SCRAPER

[76] Inventor: Robert G. Howard, Sr., P.O. Box 683, Alta Loma, Calif. 91701

[21] Appl. No.: 596,005

[22] Filed: Apr. 2, 1984

[51] Int. Cl.[4] ..... E21B 37/02

[52] U.S. Cl. ..... 166/173

[58] Field of Search ..... 166/170, 173, 174, 175; 15/104.05, 104.16, 104.18

[56] References Cited

U.S. PATENT DOCUMENTS

| | | | |
|---|---|---|---|
| 2,184,393 | 12/1939 | Luccous | 166/170 |
| 2,203,966 | 6/1940 | Otis | 166/18 |
| 2,464,390 | 3/1949 | Hammer | 166/18 |
| 2,693,239 | 11/1954 | Emanuel | 166/173 |
| 3,032,114 | 5/1962 | Best | 166/173 |
| 3,105,555 | 10/1963 | Villalon, Jr. | 166/174 |
| 3,251,418 | 4/1964 | Condra | 166/173 |
| 3,289,766 | 12/1966 | Bigelow | 166/139 |
| 3,326,294 | 6/1967 | Neilson | 166/173 |
| 3,757,859 | 9/1973 | Hammon | 166/173 |
| 4,291,764 | 9/1981 | Pampell | 166/173 |

*Primary Examiner*—Stephen J. Novosad
*Assistant Examiner*—William P. Neuder
*Attorney, Agent, or Firm*—Knobbe, Martens, Olson & Bear

[57] ABSTRACT

A well casing scraper includes a mandrel having two sets of blade mounting structures, each having a cam surface sloping axially upward and radially outward. A vertical, dovetail shaped tongue on the cam surface interlocks with a dovetail shaped slot in the back of the blade piece to permit the blade piece to slide vertically, but prevent circumferential and direct radial movement of the blade piece relative the mandrel. The back of the blade piece also includes a cam surface to slide on the mandrel cam surface so the blade piece moves radially outward as it moves axially upward, and moves radially inward as it moves axially downward. An adjustable upper sleeve for each set of blades prevents upward and outward movement. An adjustable lower sleeve and resilient sleeve permits controlled downward and radially inward movement of the blades.

The cam surfaces and upper collar ensure a constant blade diameter is maintained during the scraping operation. The lower sleeve and resilient collar permit limited retraction of the blades when the scraper is withdrawn from the casing.

16 Claims, 8 Drawing Figures

37
71
73
71
75
77
78
83
79
57
51
49
55
25
23
29
27
69
59
63
67
57
49
53
55
23
29
59
61
69
67

41
99
89
39
93
91
87
97
95

OIL WELL CASING SCRAPER

BACKGROUND OF THE INVENTION

The invention relates to apparatus for scraping the inside surface of a well casing, and is particularly useful for oil well casings.

An oil well casing, is subject to having its interior surface coated with residue and other substances. Such coating may significantly reduce the effective diameter of the casing, and interfere with proper working of the well, and may also interfere with access to the well through the casing. Therefore, the accumulated residue coating must occasionally be scraped off the interior surface of the well casing.

A variety of devices have been developed for performing that scraping function. A typical scraper scrapes the interior surface of the well casing as it is pushed down through the casing bore hole. After the scraper device has traveled the length of the casing and removed the buildup of residue from the casing walls, it is withdrawn by pulling it upward through the well casing.

To effectively scrape the casing walls, the blades of the scraper must be held firmly against the interior casing surface during the scraping operation. However, when the scraper is removed from the well, the blades should be permitted to withdraw radially in the event an obstruction is encountered, so the scraper does not become stuck in the casing.

One example of a casing scraper previously used is described in U.S. Pat. No. 4,291,764, issued Sept. 29, 1981 to Davy G. Pampell. This patent describes a scraper in which a central mandrel has scraping blades spring biased radially outward to contact the casing walls. The scraping blades and biasing springs are mounted on sloped ramp surfaces on the mandrel, so axial movement of the blades changes their radial position. An adjustable upper collar limits upward axial movement of the scraping elements. A spring biased lower collar controls downward axial movement of the blades. The continued contact of the scraping blades with the wall of the casing during the scraping action is dependent upon the biasing springs holding the blades radially outward. If a particularly heavy residue coating is present on the casing, the biasing springs may yield to the coating, and the blades will not completely remove the coating from the casing.

The problem of maintaining positive contact with the casing wall is solved somewhat by a structure shown in U.S. Pat. No. 3,251,418, issued May 17, 1966 to E. L. Condra. The Condra device ensures positive contact between the scraper element and the wall of the casing by mounting the scraping elements on a cam surface. As the scraper is moved downward through the bore hole during the scraping operation, the scraping elements are wedged against the cam surface to prevent them from moving radially inward. The outward radial position of the scraping element is controlled by a thin adjustable upper guide that limits the vertical movement of the scraping element on the cam surface. A lower collar and biasing spring allows controlled downward and radially inward movement of the scraping elements when an obstruction is encountered as the device is withdrawn upwardly through the bore hole. The Condra device, however, relies on a fairly complicated and intricate adjustment mechanism and appears to have limited protection against circumferential movement of the blades during scraping. Additionally, the device has a limited range of adjustment of the radial position of the scraper elements.

SUMMARY OF THE INVENTION

Accordingly a need exists for an improved scraping arrangement that has advantages over the prior art. Briefly stated the invention provides an improved bore hole scraper for scraping residue from the interior surface of a well casing, particularly an oil well casing. The apparatus includes an elongate mandrel that has a plurality of blade mounting cam surfaces sloping in a radially outward and axially upward direction. A longitudinal tongue is formed on each blade mounting surface to receive a blade piece. A plurality of blade pieces each have a cam surface to slide along one of the blade mounting cam surfaces of the mandrel, and a slot for fitting with the tongue on the mandrel cam surface. The blade mounting surface and the blade piece cam surface are held in sliding contact by the tongue and slot.

An adjustable upper collar prevents upward and radially outward movement of the blades pieces. An adjustable lower collar and resilient rubber-like sleeve provides limited downward and radially inward movement of the blade pieces.

The oil well casing scraper of the invention is stronger and more reliable than the devices of the prior art. Additionally, the mandrel can be made in one piece while still permitting two independently adjustable sets of blades on the mandrel.

DETAILED DESCRIPTION OF THE PREFERRED EMBODIMENT OF THE INVENTION

The Overall Scraper

Figure 1:
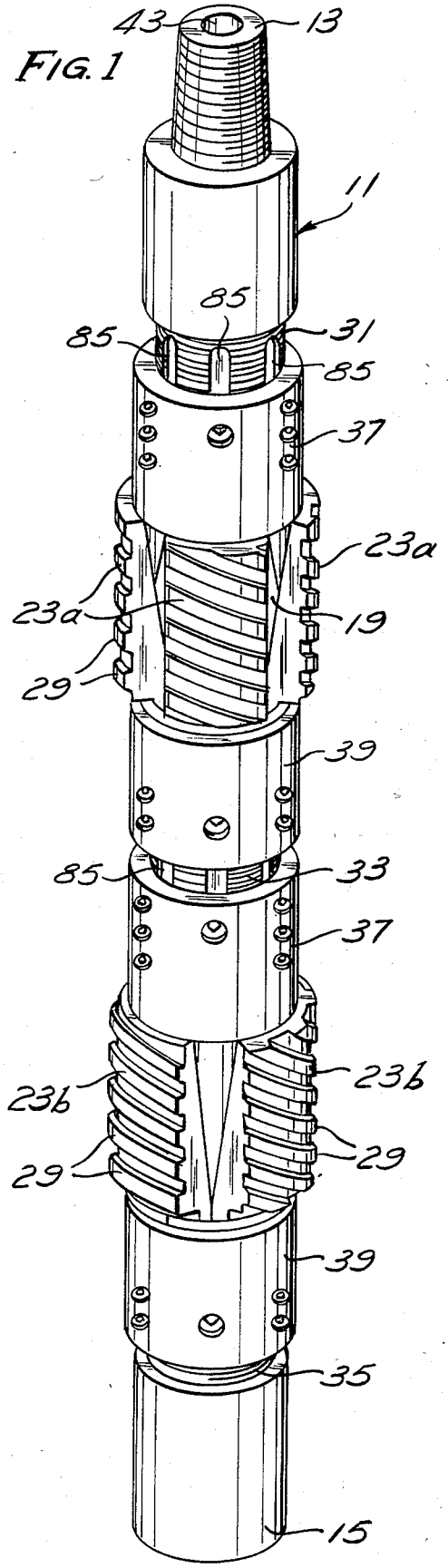
FIG. 1 is a perspective view of the assembled well casing scraper of the invention.

The well casing scraper of the invention is shown generally in FIG. 1 and includes a central mandrel 11 that is generally cylindrical in shape with a longitudinal axis. The mandrel has a first, or upper, end 13 and a second, or lower, end 15.

Figure 2:
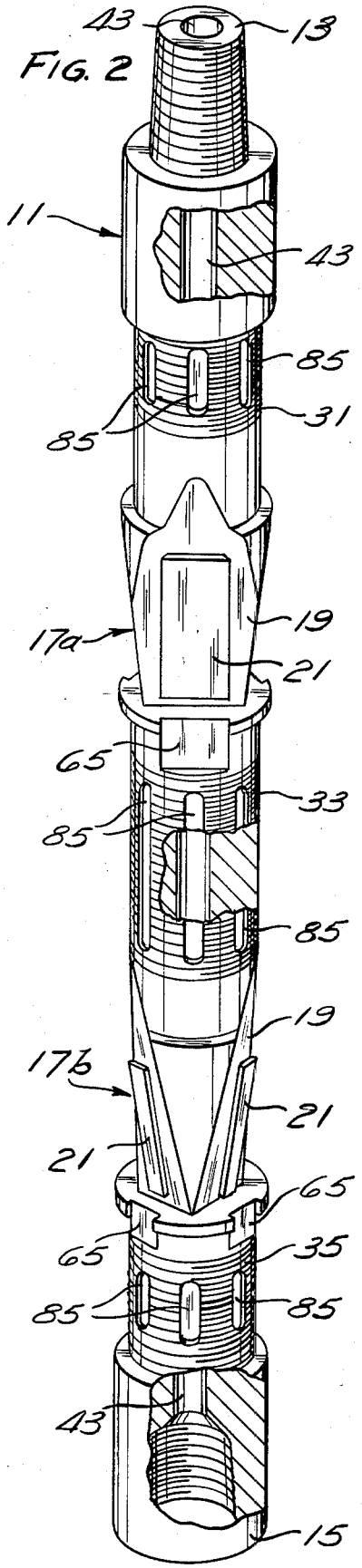
FIG. 2 is a perspective view, partially in cross section, of the mandrel of the well casing scraper of the invention.

The mandrel has formed on it at least one, and preferably two, sets of blade mounting structures 17, which are shown in FIG. 2. Each blade mounting structure 17 includes a longitudinal cam surface 19 sloping radially outward toward the first end 13 of the mandrel 11. A longitudinal dovetail tongue 21 extends along at least a portion of the length of the cam surface 19.

Blade pieces 23 mount on the blade mounting structures 17. Each blade piece 23 has a cam surface 25, FIG. 4, for mating with the cam surface 19 of the mounting structure, and a longitudinal slot 27 suitable for receiving the dovetail tongue 21 of the mounting structure surface. The cam surface 19 of the blade mounting structure on the mandrel and the cam surface 25 of the blade piece interact so that sliding the blade piece 23 axially with respect to the mandrel 11 moves the blade piece 23 radially inward or outward. The blade pieces 23 have curved blades 29 to conform to the cylindrical interior surface of a well casing.

A set of threads 31,33,35 is formed on the mandrel above and below each set of blade mounting structures 17. Upper and lower adjusting collars 37,39 mate with the threads on the mandrel. The upper adjusting collar 37 limits the axially upward and radially outward movement of the blade pieces 23. The lower collar 39 controls the axially downward and radially inward movement of the blade pieces 23.

A resilient sleeve 41, preferably of a rubber-like material, is placed between the blade pieces 23 and the lower adjusting collar 39 to provide controlled resilient downward movement of the blade pieces 23.

When a well casing is to be scraped clean, the upper collar 37 is set so the outer diameter of the blades 29 is the same as the internal diameter of the casing. As the scraper is driven down the casing, friction between the casing and the blade pieces presses the blade pieces 23 axially upward on the mandrel. However, since the upper collar 37 prevents upward movement of the blade pieces, they are held securely at the proper position. The cam surface 19 of the blade mounting structure 17 pressing against the back 25 of the blade piece 23 prevents the blade piece from moving radially inward during its downward movement. If an obstruction is encountered as the apparatus is withdrawn from the bore hole, the obstruction applies a downward force to the blade piece 23. The resilient sleeve 41 allows the blade piece to move downward and radially inward to pass the obstruction.

The Mandrel

The preferred embodiment of the mandrel 11, shown in FIG. 2, is formed of a hard material, such as steel, to withstand much hard use in well drilling and servicing work. The mandrel is preferably a one-piece substantially cylindrical body, with an axial water course or hole 43 through the center. The upper end 13 of the mandrel is threaded so the apparatus can be attached to a drill string. The mandrel can be connected, through the drill string, to a motor for rotating the scraper during the scraping operation. The lower end 15 of the mandrel is internally threaded so that it can also be attached to a well string or other apparatus.

The axial hole 43 formed through the scraper mandrel allows water or other cleansing fluids to be supplied through a central conduit commonly provided in well strings to flush scraped residue away from the scraper, so the blades do not become clogged.

In a working embodiment of this invention, the mandrel 11 has an overall length of approximately 54 inches, and the outer diameter is approximately 4½ inches. To ensure a strong scraper apparatus, it is preferred that the mandrel be formed as one piece.

The Scraping Blades and Their Mounting

It is preferred that the mandrel include mounting structures 17 for two separate, axially separated sets of scraping elements or blades 23. The two sets of scraping elements 23 can assure cleaner scraping of the casing. For example, in the preferred embodiment, three blade pieces 23 are circumferentially spaced around the mandrel. Each blade piece 23 scrapes an arc of the casing surface, but there are unscraped gaps between, unless the mandrel is rotated. With two sets of scraping elements, the blade pieces **23*a* of the first set can be circumferentially offset with respect to the blade pieces 23*b* of the second set to ensure the entire circumference of the casing surface is scraped, especially if the scraping is being done without rotating the scraping apparatus. Also, the upper set of blades 23*a* can be set at a slightly larger diameter than the lower set of blades 23*b***, with the lower set of blades set at somewhat less than the actual diameter of the casing bore hole. An advantage of such an arrangement is that the lower set of blades can scrape off some of the accumulated residue, and the upper set of blades scrapes the remaining residue down to the casing wall.

Each set of blade pieces 23 is mounted on a set blade mounting structure 17 on the mandrel. Each blade mounting structure 17 includes an elongate longitudinal sloping cam or facing surface 19 that slopes radially outward in a first axial direction toward the first end 13 of the mandrel. Thus, the end of the cam surface 19 nearest the first end 13 of the mandrel is radially outward of the end of the cam surface 19 that is nearer the second end 15 of the mandrel. In the preferred embodiment to be used in a conventional vertical well, the first end 13 of the mandrel is the upper end, so the mounting structure facing surface 19 slopes in an axially upward, radially outward direction.

Figure 8:
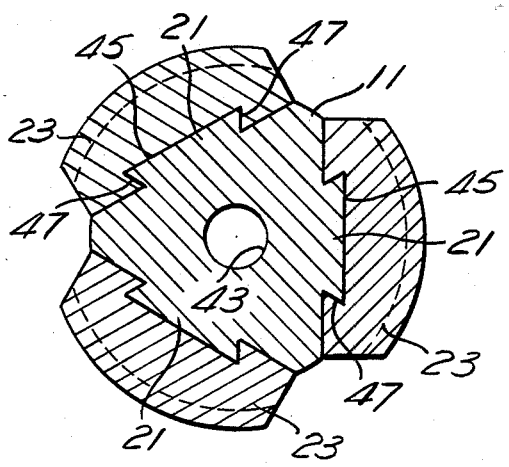
FIG. 8 is a cross sectional view of the blade mounting structure and blade pieces taken along line 8—8 of FIG. 7.

In the center of each mandrel facing surface 19 is a tongue 21 extending longitudinally along the facing surface 19. Referring to FIG. 8, the tongue 21 is preferably dovetail shaped, with an outer surface 45 substantially parallel to the plane of the facing surface 19, and longitudinal sides 47 converging toward the center of the mandrel to form a groove on each side of the tongue 21.

Figures 3, 4, 5, 6:
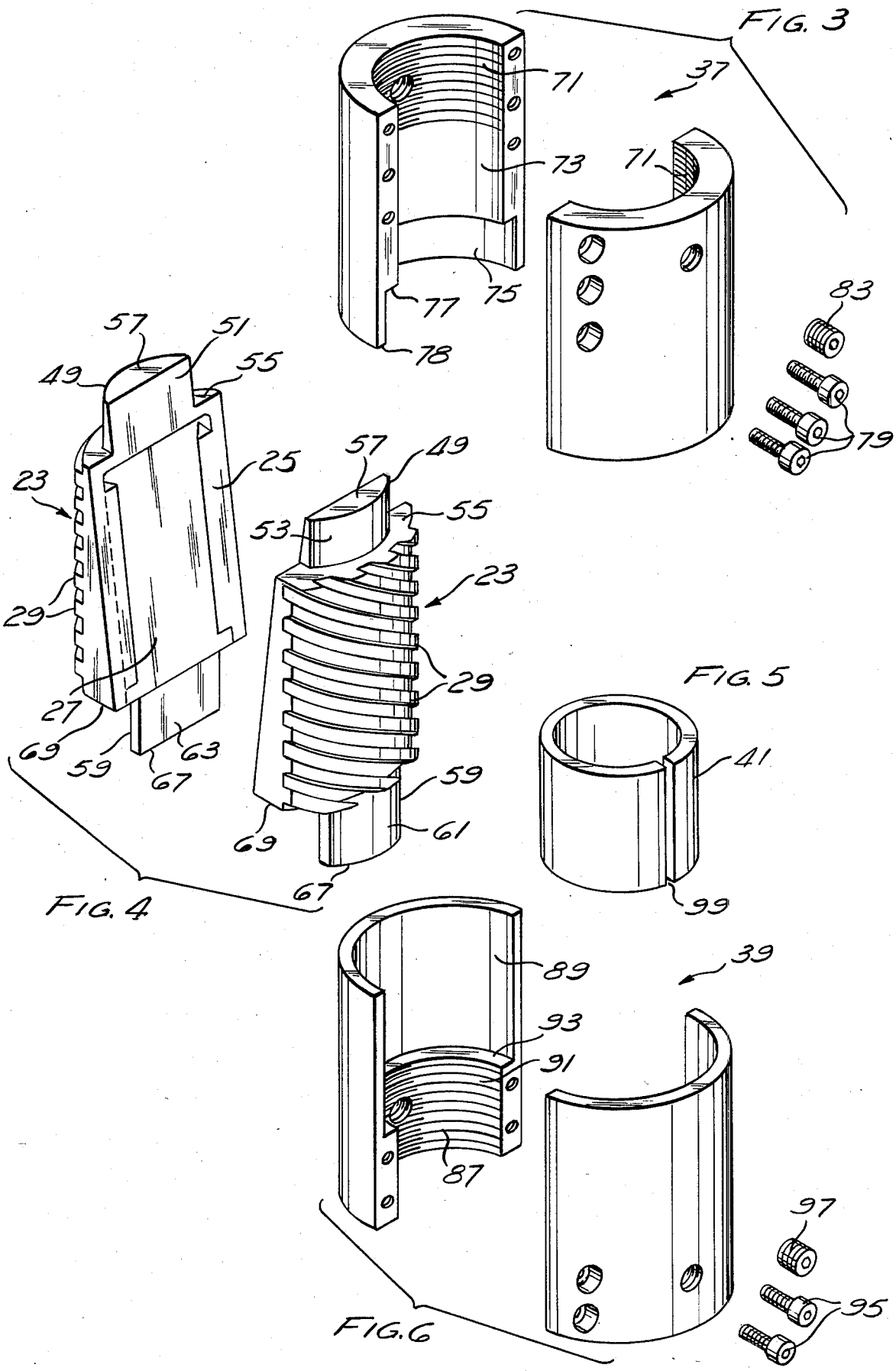
FIG. 3 is an exploded, perspective view of one of the upper adjusting collars.
FIG. 4 is a perspective view of two of the blade pieces.
FIG. 5 is a perspective view of the resilient sleeve that fits into the lower adjusting collar.
FIG. 6 is an exploded perspective view of one of the lower adjusting collars.

A blade piece 23 is to be mounted on each blade mounting structure 17. Two blade pieces 23 are shown in FIG. 4. Each blade piece includes a flat back facing or cam surface 25 that is adapted to fully contact and slide on the facing or cam surface 19 of the mounting structure. A set of blades 29 is formed on the front of the blade piece 23.

In the back facing surface 25 of the blade piece is a longitudinal dovetail slot 27 adapted to receive the dovetail tongue 21 of the blade mounting structure. The interaction of the dovetail tongue 21 of the blade mounting structure and the mating slot 27 of the blade piece is seen in FIG. 8. The indented sides 47 of the dovetail tongue interlock with the edges of the blade piece slot 27 to hold the blade piece 23 securely to the facing surface 19 of the blade mounting structure and to prevent lateral movement of the blade piece 23.

The blade pieces are manufactured of high alloy steel. The blade teeth 29 are flame hardened to give added strength and resistance to wear.

The blades 29 on the outer surface of the blade piece 23 are preferably sloped or angled. Scraping is easier with the angled blades 29 as the scraper moves down the casing than if the blade edges were perpendicular to the direction of scraper travel.

Each blade piece 23 preferably has an upper extension 49 having a flat back surface 51 and a curved front surface 53. The upper extension 49 is preferably about one inch long. The flat back 51 of the upper blade piece extension 49 makes firm contact with the upper end of the mandrel blade piece mounting structure facing surface 19. The outer surface 53 of the upper extension is curved to fit within the upper adjusting collar 37 described below. A shoulder 55 is thereby formed on the upper end of the blade piece 23 around the upper extension 49. The end 57 of the upper extension forms a substantially flat facing surface. The upper extension 49 mates with the upper adjusting collar 37 to control the axial and radial movement of the blade piece 23.

Each blade piece 23 also advantageously includes a lower extension 59 having, preferably, a curved outer surface 61 and a flat inner surface 63. The lower extension 59 is ideally about two inches long.

The lower extension 59 of each blade piece fits in a slot 65 formed in the mandrel below the blade mounting structure 17 (see FIG. 2). The edges of the slot 65 should fit closely with the edges of the lower extension 59 of the blade piece, so when the apparatus is assembled and being used, the slot 65 helps prevent the blade piece 23 from moving circumferentially on the mandrel. The lower extension 59 has a curved inner surface 63 to fit around the mandrel and a curved outer surface 61 to fit within the lower adjusting collar 39 described below. The end 67 of the lower extension 59 is a substantially flat facing surface. A shoulder 69 is formed on the bottom edge of the blade piece 23 around the lower extension 59. The lower extension 59 of the blade piece mates with the resilient sleeve 41 and the lower adjusting collar 39 to provide controlled axial and radial movement of the blade piece 23.

Each set of blade structures preferably consists of three blade mounting structures 17 and mating blade pieces 23. The facing surfaces 19 of the blade mounting structures are preferably offset from each other by 60 degrees to give uniform spacing of the blade pieces 23 about the circumference of the mandrel.

As previously discussed, there are preferably two axially separated sets of blade structures 17. The second or lower set **17*b* is preferably rotationally offset from the first set 17*a*** to ensure complete 360 degree scraping. For example, in the preferred embodiment in which each blade set includes three blade pieces offset 120 degrees relative each other, the second blade set is preferably offset 60 degrees with respect to the first blade set so each blade piece of the second blade set covers the gap between the blade pieces of the first blade set, and the blade pieces of the first blade set cover the gaps between the blade pieces of the second blade set.

The Adjusting Collars

The blade pieces 23 of each set are held in place axially and radially by a pair of adjusting collars 37,39. A first or upper adjusting collar 37 controls the movement of the blade pieces 23 in the first or upward direction, and a lower adjusting collar 39 controls the axial movement of the blade pieces in a second, or downward direction. As the cam or facing surfaces 19 of the blade mounting structures are sloped so that axial and radial movement of the blade pieces 23 occurs simultaneously, control of the axial movement of the blade pieces 23 by the upper and lower adjusting collars 37,39 also controls the radial movement of the blade pieces.

The mandrel is threaded above each set of blade mounting structures 17 to receive the upper adjusting collar 37. The mandrel is also threaded below each set of blade mounting structures 17 to receive the lower adjusting collar 39. As is apparent from FIG. 2, it is preferable that the threads 33 for the lower adjusting collar **39*a* of the first blade set and the upper adjusting collar 37*b* of the second blade set be combined to provide maximum flexibility in the adjustment of the collars. The outer diameter of the mandrel at the threads 31,33,35** is approximately $3\frac{5}{8}$ inches in a working embodiment of the apparatus.

Figure 7:
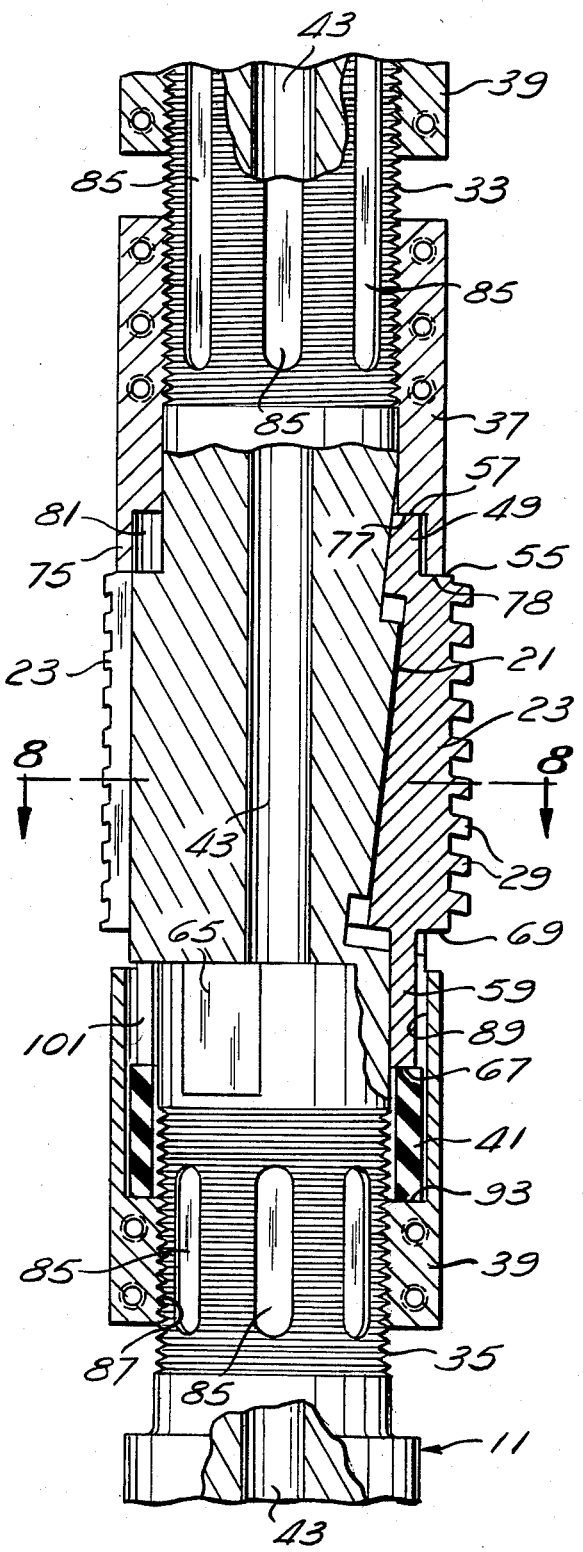
FIG. 7 is an enlarged view, partially in elevation, partially in cross section, of a portion of the assembled scraper of the invention.

The upper adjusting collar 37 is a substantially tubular body. At least a portion 71 of the internal surface of the collar is threaded to mate with the threads of the mandrel above the blade mounting structures. The upper collar preferably has a first portion 73 having a first inner diameter, and a second portion 75 having a second, larger inner diameter. An axially facing annular ledge 77 is formed where the two portions 73,75 meet. The outer diameter of the upper collar 37 may, for example, be $4\frac{7}{8}$ inches, and the second, larger inner diameter of the collar is $4\frac{1}{2}$ inches, as they are in a working embodiment of the device. The second portion 75 of the upper collar ideally has the same axial length as the length of the upper extensions 49 of the blade pieces 23, so when the top edge 57 of the blade piece extension 49 contacts the annular ledge 77 of the collar, the upper shoulder 55 of the blade piece contacts the bottom edge 78 of the upper collar 37, as shown in FIG. 7.

The upper collar 37 is preferably formed as two halves that can be assembled around the mandrel. The halves are joined together by a set of fasteners, such as bolts or screws 79. Once assembled on the mandrel, the upper adjusting collar 37 can be moved upward or downward on the threads 31,33. An annular space 81 is formed between the mandrel and the inner surface of the second portion 75 of the upper collar 37.

Set screws 83 are used to lock the upper adjusting collar 37 in position with respect to the mandrel. Formed in the threaded portion 31,33 of the mandrel are slots 85 for receiving the set screws 83. Each slot may be $\frac{5}{8}$ inch wide and $\frac{1}{8}$ inch deep. The set screws are screwed through the collar so their tips project into these slots. It is believed that three set screws 83 should be used for the collar 37.

When the upper adjusting collar 37 has been assembled on the mandrel, and the blade pieces 23 are attached to their blade mounting structures 17, the upper extension 49 of each blade piece 23 nests inside the second portion 75 of the upper collar. The top edge 57 of the extension abuts the ledge 77 formed by the joint between the different diameter sections of the collar 37. The outer rim 78 of the collar 37 abuts the upper shoulder 55 on the blade piece 23. In this manner, two surfaces 55,57, on each part, 77,78 bear the force of the scraping operation for greater distribution of the scraping forces, reducing the possibility of failure of one of the parts.

The lower adjusting collar 39 for each blade set also has a threaded portion 87 for mating with the threads 33,35 on the mandrel below the blade mounting structures 17. The lower collar 39 also has two portions, the first portion 89 having a first inner diameter, and the second portion 91 having a second inner diameter, which is smaller than the first inner diameter. Between the first portion 89 and the second portion 91 is an internal ledge or seat 93 facing axially upward. The collar threads 87 are formed on the inner surface of the second portion of the collar. In a device actually constructed incorporating the invention, the outer diameter of the lower collar 39 is $4\frac{7}{8}$ inches and the first, larger inner diameter is $4\frac{1}{2}$ inches. The diameter of the mandrel threads 33,35 for the lower collar is approximately $3\frac{5}{8}$ inches.

The lower adjusting collar 39, like the upper collar 37, is preferably formed in two halves that are fastened together around the mandrel using bolts or other fasteners 95. The threaded portion 87 mates with the threads 33,35 on the mandrel to allow the collar 39 to be adjusted axially upward or downward on the mandrel. Once the proper position has been reached, the set screws 97 can be used to lock the collar in place by screwing them through the collar 39 so they project into the slots 85 in the mandrel.

A resilient tubular sleeve 41, preferably manufactured of resilient neoprene rubber having a durometer rating of 40, is placed around the mandrel inside the first portion 89 of the lower collar 39 having the first larger diameter. The resilient sleeve 41 is shorter in its axial dimension than the axial dimension of the first portion 89 of the lower collar, and seats on the internal ledge 93 of the lower collar. The resilient sleeve 41 is preferably formed in one piece, with an axially-extending slit 99 to permit the sleeve 41 to be slipped over the mandrel. The outer diameter of the sleeve 41 should be no larger than the first inner diameter of the lower collar 39 so the sleeve does not bind on the inner surface of the first portion 89 of the collar. The inner diameter of the sleeve 41 should be no smaller than the diameter of the mandrel to avoid binding on the mandrel. The slit resilient sleeve 41 allows the mandrel to be made as one piece, since the sleeve can be placed around the mandrel anywhere along the length of the mandrel. A coil spring must be installed on the end of the mandrel. If a portion of the mandrel has a larger diameter than the spring, the spring cannot be moved along the mandrel past that point. Thus, the split resilient sleeve 41 allows two or more sets of blade mounting structures 17 to be placed anywhere along the mandrel, so each set is independently adjustable, and each set moves independent of the other.

When the scraper is assembled, the lower extension 59 of each blade piece 23 extends into the annular space 101 between the first portion 89 of the lower collar and the mandrel, and rests on the upper edge of the resilient sleeve 41. The first portion 89 of the lower collar thereby prevents lateral movement of the bottom edge of the blade piece.

The upper and lower collars 37,39 for each set of blade pieces 23 allow the radial dimension of the blades 29 to be adjusted to match the diameter of the casing to be scraped. As previously discussed, the sloped blade mounting cam or facing surface 19 and the back surface 25 of the blades cause the blades 23 to move radially in response to axial movement. In the preferred embodiment shown, moving the blades 23 axially toward the first or upper end 13 of the mandrel causes the blades to move radially outward, and moving the blades axially downward causes them to move radially inward. Thus, to set the blades to scrape a larger diameter casing, the blades are moved axially upward. To scrape a smaller diameter casing, the blades are moved axially downward.

Assembly

To assemble the scraper described, the blade pieces 23 are slipped onto the blade mounting structures 17 with the dovetail tongue 21 of each mounting structure fitting into the slot 27 in the back of the blade piece 23. The upper adjusting collars 37 are assembled around the mandrel and the upper extensions 49 of the blade pieces 23 of each blade piece set. The halves of each collar 37 are fastened together. The resilient sleeves 41 are placed around the mandrel, each just below the lower extensions 59 of the blade pieces 23 of one set. Then the lower collars 39 are assembled and fastened around the mandrel and resilient sleeves 41.

To adjust the blades, the top adjusting collar 37 is moved axially upward. The blade pieces 23 are then moved axially upward until they are set at a radial diameter slightly larger than required. The lower collar 39 is moved upward until the resilient sleeve 41 contacts the lower projections 59 of the blade pieces. The set screws 97 of the lower collar 39 are screwed in so they project into the axial slots 85 in the mandrel to lock the collar 39 in position. Then the upper adjusting collar is adjusted to press the blade pieces against the resilient sleeve until the blades are set at the proper diameter. Then, the set screws 83 of the upper collar 37 are used to lock the collar 37 in position by screwing the screws 83 in until they extend into the axial mandrel slots 85.

The upper collar 37, with its solid engagement with the upper edge 57 of the blades, positively prevents further upward (and radially outward) movement of the blades. The lower collar 39 and resilient sleeve 41 hold the blade pieces 23 against the upper collar 37 and in position in normal use. During a scraping operation, the entire assembly is moved downward through the casing bore hole. The pressure of the scraping operation tends to press the blades 23 in an upward direction. However, because of the firm engagement with the upper collar 37, the blades 23 are held at their proper position and not allowed to expand radially to press too hard against the casing walls. Additionally, the solid engagement of the back surfaces 25 of the blade pieces with the facing surfaces 19 of the blade mounting structures 17 ensures that the blades 29 maintain proper contact with the casing at all times, and are not pushed inward by particularly heavy residue buildup. The lower collar 39 and resilient sleeve 41 maintain adequate pressure on the blade pieces 23 to maintain the proper blade diameter when the assembly is at rest.

The two surfaces 77,78 on the upper collar 37 against which each blade piece 23 bears during the scraping operation distributes the pressure force of the scraping operation over a relatively large area to lessen the possibility of failure of one of the parts due to excessive force being applied to it.

To scrape the interior surface of a well casing, the scraper can be pushed down the bore hole either with or without rotation.

As discussed above, the preferred embodiment of the scraping assembly has two sets of blades 23. The two sets of blades can be set to the same diameter, and thereby assure complete scraping of the full circumference of the casing. Alternatively, they can be set at different diameters for different scraping objectives. For example, it may be desirable when the casing is coated with a particularly heavy buildup of residue, to set the lower or second set of blades **23*b* at a smaller diameter than the first set 23*a*** so the lower set of blades 23*b* scrapes a layer of residue buildup from the casing, but does not scrape all the way to the casing wall, and the upper set of blades 23 scrapes the remaining residue to the casing walls. This reduces the scraping work that needs to be done by each set of blades, which may reduce wear on the blades and the assembly as a whole, and may also have the operation move faster. The use of the resilient sleeve 41 allows a one piece mandrel to be constructed with two sets of blade mounting structures 17 and blades 23, since the sleeve 41 can be slipped over the mandrel at its middle, and does not need to be installed from the end.

When the assembly is withdrawn from the casing, it is possible that minor obstructions could be encountered as the piece is withdrawn from the casing. In the event that an obstruction is encountered, the obstruction would tend to push the blade piece 23 downward as the assembly is moving upward through the casing. The resilient sleeve 41 in the lower collar 39 permits limited axial movement of the blade piece 23 in response to such pressure. The sloping facing surfaces 25,19 of the blade piece and the mounting structure, and the secure fit of the dovetail tongue 21 and slot 27 assembly cause the blade piece 23 to move radially inward as it is forced axially downward. Once the blade piece 23 has moved sufficiently inward to avoid the obstruction, the scraper can continue to be moved upward through the casing. After the blade piece 23 is past the obstruction, the blade piece 23 again returns to its proper diameter by action of the resilient sleeve 41. Because each blade piece 23 rests directly on the resilient sleeve 41, when only one blade piece 23 of a set encounters an obstruction, only that piece is moved, rather than moving all the blade pieces of the set.

The lower collar 39 can be adjusted to provide varying amounts of resistance to downward and radially inward movement of the blades 23. Adjusting the lower collar 39 so it bears more heavily on the resilient sleeve 41 compresses the sleeve to increase the downward pressure needed on the blades 23 to cause axial movement, and also more severely limits the amount of axial movement possible. Once the tops 57 of the blade pieces contact the upper collar 37, the blade pieces 23 cannot move any farther upward. Therefore, continued upward adjustment of the lower collar 39 compresses the resilient sleeve 41. As the sleeve is compressed, continually greater force is required to further compress the sleeve. However, excessive compression of the sleeve 41 may cause it damage. Conversely, lessening the pressure applied to the resilient sleeve 41 allows a lesser downward force to move the blades 23.

I claim:

1. An apparatus for scraping a bore hole, comprising:

a substantially cylindrical mandrel having an axis and a longitudinal cam surface sloping radially outward in a first axial direction;

a blade piece having a cam surface for slidably engaging the mandrel cam surface so that moving the blade piece in the first axial direction with respect to the mandrel causes the blade piece to move radially outward with respect to the mandrel, and moving the blade piece in a second, opposite axial direction causes the blade piece to move radially inward with respect to the mandrel wherein the mandrel and the blade piece interact by means of a longitudinal tongue and slot structure so that as the blade piece and the mandrel move axially with respect to one another, the tongue slides longitudinally in the slot;

a first collar around the periphery of the mandrel adapted to abut the blade piece to prevent axial movement of the blade piece in the first direction, wherein the axial position of the first collar is adjustable; and a second collar around the periphery of the mandrel, axially remote from the first collar to control movement of the blade piece in the second direction, wherein the axial position of the second collar is adjustable;

the longitudinal tongue and slot structure comprises:

a longitudinal tongue formed on the cam surface of the mandrel; and a longitudinal slot formed in the blade piece, the slot adapted to fit with the mandrel cam surface tongue.

2. The apparatus defined in claim 1, wherein:

the tongue has an outer surface substantially parallel to the plane of the cam surface, and has longitudinal sides converging toward the axis of the mandrel to form a groove along each side of the tongue; and the slot is formed with edges to fit into the grooves on the longitudinal sides of the tongue.

3. An apparatus for scraping a bore hole, comprising:

a substantially cylindrical mandrel having an axis and a longitudinal cam surface sloping radially outward in a first axial direction;

a blade piece having a cam surface for slidably engaging the mandrel cam surface so that moving the blade piece in the first axial direction with respect to the mandrel causes the blade piece to move radially outward with respect to the mandrel, and moving the blade piece in a second, opposite axial direction causes the blade piece to move radially inward with respect to the mandrel wherein the mandrel and the blade piece interact by means of a longitudinal tongue and slot structure so that as the blade piece and the mandrel move axially with respect to one another, the tongue slides longitudinally in the slot;

a first collar around the periphery of the mandrel adapted to abut the blade piece to prevent axial movement of the blade piece in the first direction, wherein the axial position of the first collar is adjustable;

a second collar around the periphery of the mandrel, axially remote from the first collar to control movement of the blade piece in the second direction, wherein the axial position of the second collar is adjustable; and a resilient elastomeric sleeve surrounding the mandrel, axially between the blade piece and the second collar, wherein one edge of the sleeve abuts the second collar and the opposite edge of the sleeve abuts the blade piece, to urge said cam surfaces into engagement and to allow movement of the blade piece in the second axial direction on the application of force in the second axial direction.

4. The apparatus defined in claim 3, wherein the mandrel has a second cam surface and a third cam surface, each cam surface substantially similar to the first cam surface, wherein the apparatus additionally comprises:

second and third blade pieces, each substantially similar to the first blade piece, wherein:

the cam surface of the second blade piece slidably engages the second mandrel cam surface, whereby moving the second blade piece in the first axial direction causes the second blade piece to move radially outward, and moving the second blade piece in the second axial direction causes the blade piece to move radially inward;

the cam surface of the third blade piece slidably engages the third mandrel cam surface, whereby moving the third blade piece in the first axial direction causes the third blade piece to move radially outward with respect to the mandrel, and moving the third blade piece in the second axial direction causes the third blade piece to move radially inward; wherein:

the first collar abuts the second and third blade pieces to prevent axial movement of the blade pieces in the first direction; and the resilient sleeve abuts the second and third blade pieces to allow resilient movement of the second and third blade pieces in the second direction on the application of force in the second direction.

5. A bore hole scraping apparatus comprising:

a substantially cylindrical mandrel having a first end and a second end, wherein the mandrel includes a blade mounting structure comprising:

a longitudinal facing surface having a first end nearer the first end of the mandrel, and a second end nearer the second end of the mandrel, wherein the facing surface slopes so the first end is radially outward of the second end;

a longitudinal tongue formed on the facing surface;

a blade piece, comprising:

a back surface for mating with the facing surface of the blade mounting structure;

a slot in the back surface adapted to fit with the tongue on the facing surface of the blade mounting structure so the tongue slides in the slot as the blade piece moves axially with respect to the mandrel, wherein such axial movement causes the back surface of the blade piece to slide on the facing surface of the blade mounting structure, so that as the blade piece moves axially toward the first end of the mandrel, it moves radially outward, and as the blade piece moves axially toward the second end of the mandrel, it moves radially inward.

6. The bore hole scraping apparatus defined in claim 5, wherein the mandrel includes plural blade mounting structures, each substantially identical to the first blade mounting structure, and additionally comprising plural blade pieces, each substantially identical to the first blade piece, wherein the number of blade pieces is identical to the number of blade mounting structures, and each blade piece interacts with a blade mounting structure in a manner substantially identical to the interaction of the first blade piece and the first blade mounting structure.

7. The bore hole scraping apparatus defined in claim 6, additionally comprising:

a first adjustable collar around the mandrel, adapted to abut the first ends of the blade pieces to limit the movement of the blade pieces axially toward the first end of the mandrel;

a resilient sleeve surrounding the mandrel, one edge of which is adapted to abut the second end of the blade pieces; and a second collar surrounding the mandrel, and adapted to abut the opposite edge of the resilient sleeve, so the resilient sleeve is held between the second collar and the blade pieces to allow resilient movement of the blade pieces toward the second end of the mandrel.

8. A well casing scraper comprising:

an elongate mandrel having a first end and a second end, wherein the mandrel includes a blade mounting structure comprising:

an elongate substantially flat cam surface having a first end nearer the first end of the mandrel and a second end nearer the second end of the mandrel, wherein the cam surface slopes so the first end is more remote from the mandrel axis than the second end;

a longitudinal tongue formed on the cam surface, wherein the tongue has a front surface substantially parallel the plane of the cam surface and has a pair of longitudinal sides converging toward the mandrel axis to form a longitudinal groove along each longitudinal side;

a blade piece mounted on the blade mounting structure, the blade piece having a first end axially nearer the first end of the mandrel and a second end axially nearer the second end of the mandrel, wherein the blade piece has a back surface adapted to firmly contact the cam surface of the mandrel blade mounting structure and having a slot formed in the back surface, wherein the slot is shaped to conform to the shape of the blade mounting structure tongue so the edges of the slot interlock with the longitudinal slots on the tongue so the blade piece slides longitudinally on the blade mounting structure.

9. A well casing scraper, comprising:

an elongate, substantially cylindrical mandrel, the mandrel having a top end and a bottom end, and including:

an axial bore for fluid flow;

first and second threads on the periphery of the mandrel, wherein the first thread is axially closer to the top end of the mandrel and the second thread is axially closer to the bottom end of the mandrel;

a plurality of cam surfaces axially between the threads, each of the cam surfaces tapering radially inwardly in the axially downward direction and each having a tongue extending in an axial direction;

an upper adjustable collar, comprising a tube having an outer diameter larger than the diameter of the mandrel, wherein the collar is internally threaded to mate with the first mandrel thread;

a lower adjustable collar comprising a cylinder having an outer diameter larger than the diameter of the mandrel, and having a first upper portion having an inner diameter, larger than the diameter of the mandrel, and having a second, lower portion internally threaded to mate with the second mandrel thread, wherein the inner diameter of the first portion is larger than the inner diameter of the second portion forming an inner ledge surface between the first and second portions, the rim surface facing axially upward;

a tubular sleeve formed of resilient material having an upper edge and a lower edge, and having an outer diameter not larger than the inner diameter of the first portion of the lower adjusting collar, the sleeve adapted to fit into the first, upper portion of the lower adjusting collar with its lower edge seated on the inner ledge surface of the lower adjusting collar;

a plurality of blade pieces, each having a set of blades formed on one side thereof and having on the other side a tapered cam surface for mating with one of the tapered mandrel cam surfaces and having a slot to mate with the slot in the tapered mandrel cam surface, each blade piece additionally including a lower edge to seat against the top edge of the resilient sleeve and an upper edge to seat against the upper adjustable collar; wherein:

as each blade piece moves in an axially upward direction, the interaction of the blade piece cam surface and the mandrel cam surface causes the blade piece to move radially outward;

as each blade piece moves in an axially downward direction, the interaction of the blade piece cam surface and the mandrel cam surface causes the blade piece to move in radially inward;

the upper adjustable collar abutting the top of the blade pieces prevents the movement of the blade pieces in an axially upward and radially outward direction;

the lower adjustable collar and the resilient sleeve seated between the inner ledge of the lower adjustable collar and the blade pieces resiliently control the movement of the blade pieces in an axially downward and radially inward direction;

the axial position of the upper collar is adjustable using the internal thread of the collar and the first mandrel thread;

the axial position of the lower collar is adjustable using the internal thread of the lower collar and the second mandrel thread.

10. The well casing scraper defined in claim 9, wherein each of the blade pieces has a lower extension that includes a bottom edge that seats against the top edge of the resilient sleeve and wherein the axial dimension of the rubber sleeve is less than the axial dimension of the second, upper portion of the lower adjustable collar, and the lower extensions of the blade pieces are adapted to fit in the annular space between the upper portion of the lower adjustable collar and the mandrel when the blade piece extensions are seated on the resilient sleeve.

11. The casing scraper defined in claim 10, wherein the mandrel includes a plurality of projections, the number of projections equal to the number of blade pieces and mandrel cam surfaces, wherein the projections extend radially outward from the mandrel, and the lower extensions of the blade pieces extend between the projections to prevent circumferential movement of the blade pieces.

12. The casing scraper defined in claim 9, wherein the mandrel has axial slots formed in each of the threaded portions, and additionally comprising:

set screws adapted to extend through the upper adjusting collar into the slots in the first thread to prevent circumferential movement of the upper collar; and set screws adapted to extend through the lower adjusting collar into the slots in the second threads to prevent circumferential movement of the lower adjusting collar.

13. The casing scraper defined in claim 9, having three mandrel cam surfaces and three blade pieces, wherein the cam surfaces are oriented at approximately sixty degrees relative to each other on the circumference of the mandrel.

14. A well casing scraper comprising:

an elongate single piece mandrel having a pair of axially separated blade mounting structures;

two sets of blade pieces, each set of blade pieces comprising a plurality of individual blade pieces mounted on the blade mounting structures, wherein the blade pieces and the blade mounting structures interact so axial movement of a blade piece causes radial movement of the blade piece;

a set of upper and lower collars for each set of blade pieces for independently controlling axial movement of each set of blade pieces;

a resilient sleeve between each set of blade pieces and the lower collar for that set of blade pieces, the sleeve allowing limited axially downward movement of the blade pieces.

15. The well casing scraper defined in claim 14, wherein the axial position of each upper collar and each lower collar is independently adjustable to permit independent adjustment of the axial position of each set of blade pieces.

16. The well casing scraper defined in claim 14, wherein each blade piece in a set can move axially downward substantially independently of the other blade pieces of the set.

* * * * *